US005518199A

United States Patent [19]

Welp et al.

[11] Patent Number: 5,518,199

[45] Date of Patent: May 21, 1996

[54] MACHINE FOR WINDING PAPER STRIPS CUT FROM A WIDE PAPER WEB

[75] Inventors: Ewald G. Welp, Erkrath; Herbert Schönmeier, Düsseldorf; Willi Heymanns, Kaarst; Reinhard Hehner, Haan, all of Germany

[73] Assignee: Jagenberg Aktiengesellschaft, Dusseldorf, Germany

[21] Appl. No.: 256,842

[22] PCT Filed: Jan. 22, 1993

[86] PCT No.: PCT/EP93/00140

§ 371 Date: Jul. 26, 1994

§ 102(e) Date: Jul. 26, 1994

[87] PCT Pub. No.: WO93/15988

PCT Pub. Date: Aug. 19, 1993

[30] Foreign Application Priority Data

Feb. 18, 1992 [DE] Germany ..... 42 04 839.7

[51] Int. Cl.[6] ..... B65H 18/14

[52] U.S. Cl. ..... 242/530.4; 242/541.6; 242/542.1

[58] Field of Search ..... 242/530, 530.4, 242/541, 541.4, 541.5, 541.6, 541.7, 542, 542.1, 542.2, 542.3, 542.4, 544, 547

[56] References Cited

U.S. PATENT DOCUMENTS

| | | | |
|---|---|---|---|
| 984,024 | 2/1911 | Pringle | 242/541.5 |
| 3,098,619 | 7/1963 | Washburn | 242/542.2 |
| 3,240,442 | 3/1966 | Kilmartin | 242/542 |
| 3,702,687 | 11/1972 | Hall | 242/542.4 |
| 3,750,973 | 8/1973 | Walters | 242/530.4 |
| 3,937,410 | 2/1976 | Justus | 242/541.5 |
| 4,139,166 | 2/1979 | Powell et al. | 242/542.2 |
| 4,496,112 | 1/1985 | Olsson et al. . | |
| 4,508,283 | 4/1985 | Beisswanger | 242/530 |
| 4,811,915 | 3/1989 | Smith | 242/541.6 |
| 4,867,387 | 9/1989 | Schönmeier . | |
| 4,877,196 | 10/1989 | Heymanns . | |

FOREIGN PATENT DOCUMENTS

| | | |
|---|---|---|
| 424788 | 12/1937 | Belgium . |
| 498962 | 5/1930 | Germany . |

*Primary Examiner*—John P. Darling
*Attorney, Agent, or Firm*—Herbert Dubno; Andrew Wilford

[57] ABSTRACT

An elongated support roller centered on and rotatable about a horizontal axis radially engages at least one row of takeup rolls coaxial to a takeup-roll axis parallel to the support-roller axis and including at least one central roll and a pair of end rolls axially flanking the central roll. A relatively wide paper web fed to the support roller passes through a slitter between the web supply and the support roller for slitting the web into a plurality of strips including at least one central strip and a pair of end strips flanking the end strip. The central and end strips pass at least partially around the support roller and are wound on the respective central and end rolls. The support roller is rotated about its axis so that the strips wind at least partially around the support roller and at least the central roll is rotated by engagement with the support roll. Respective end-roll periphery drives radially engage the end rolls for rotating same at a greater peripheral speed than the support roller.

8 Claims, 2 Drawing Sheets

MACHINE FOR WINDING PAPER STRIPS CUT FROM A WIDE PAPER WEB

FIELD OF THE INVENTION

The present invention relates to a machine for making paper or cardboard rolls. More particularly this invention concerns a method of and apparatus for winding paper strips cut from a light-gauge wide paper web into individual rolls.

BACKGROUND OF THE INVENTION

Winding machines are known for making wound rolls from individual webs produced by longitudinal slitting of paper or cardboard webs wherein the wound rolls engage peripherally during winding against one or two driven support of carrying rollers. In these winding machines called periphery winders the wound rolls are rotated by the driven support or carrier roller during winding. German 3,933,861 describes this type of support-roller machine where the wound rolls are arranged alternately to both sides of a vertical diameter plane of a central support roll against which they engage during winding. Freely rotatable guide heads are engaged in the ends of the sleeve of each wound roll to partially or wholly support the roll weight.

It is known from German 4,012,979 to connect each guide head with a rotary drive in order to individually control the tension of each wound roll during winding. These additional center drives are very expensive in the working of very wide (8 m and more) paper webs with several winding stations (10 and more) and in addition increase the minimum width of a wound roll since the driven guide heads cannot be lowered on the winding support to fit them with new sleeves and to unload the wound rolls.

Practice has shown that with papers with low weight per unit area, in particular newsprint, undesired crepe folds are formed in the two outer wound rolls (end rolls) under certain circumstances when they are wound with winding machines where the wound rolls are exclusively rotated by the driven support or carrying roll during winding.

OBJECT OF THE INVENTION

It is an object of the invention so to improve the described type of winding machine that end rolls of better quality can be produced with minimal constructive costs.

Another object is to provide an improved method of winding up paper strips into rolls and of operating a roll-making machine of the above-described type.

SUMMARY OF THE INVENTION

These objects are attained according to the instant invention in a roll making machine having an elongated support roller centered on and rotatable about a horizontal axis and at least one row of takeup rolls coaxial to a takeup-roll axis parallel to the support-roller axis and including at least one central roll and a pair of end rolls axially flanking the central roll. The rolls are closely juxtaposed with the support roller and at least the central roll radially engages the support roller. A relatively wide paper web is fed to the support roller and a cutter between the web supply and the support roller slits the web into a plurality of strips including at least one central strip and a pair of end strips flanking the end strip. The central and end strips pass at least partially around the support roller and are wound on the respective central and end rolls. The support roller is rotated about its axis so that the strips wind at least partially around the support roller and at least the central roll is rotated by engagement with the support roll. According to the invention respective end-roll periphery drives radially engage the end rolls and rotate same at a greater peripheral speed than the support roller.

It has been shown that with newsprint the paper web does not have a uniform length but is longer at the edges of the web. Thus the web tension before winding is less for the two end rolls than for the central rolls and this must be compensated for to obtain a uniform roll hardness of a rolling setup with an increased line load on the contact line of the edge rollers and the support or carrying roller. The different relationship between web tension and line load with the end rolls increases the likelihood that crepe folds will appear.

According to the invention the web tension of the end rolls can be increased independently of the remaining rolls by a uniform torque on the rotary drives in order to compensate for irregularities in the web. Center drives used at the end are more expensive to make since they cannot work with uniform torque and in addition a great number are required in order to equip the end rolls of all of the winding stations for various format combinations.

While the periphery drives movable perpendicular to the web travel direction can be set for various format widths, the elastic and grooved-surface rollers or belt avoid potential damage on engagement and problems of trapped air.

A roller with an integrated drum drive is constructively advantageous and takes up little space. The two outermost pusher rollers which are used at the start of a winding to increase the line load are also preferably used as the periphery drives for the end rolls.

During winding in two winding lines there is at each end of a winding line an additional periphery drive, making all together four periphery drives, in order to be able to distribute a varying number of wound rolls with different format widths in the two winding lines. Thus the instant invention proposes a winding machine for winding wide paper webs where the width of the driven rollers or belts is conformed to the necessary increase of tension at the ends.

BRIEF DESCRIPTION OF THE DRAWING

The drawing serves for describing the invention with reference to a simplified illustrated embodiment.

SPECIFIC DESCRIPTION

Figure 1:
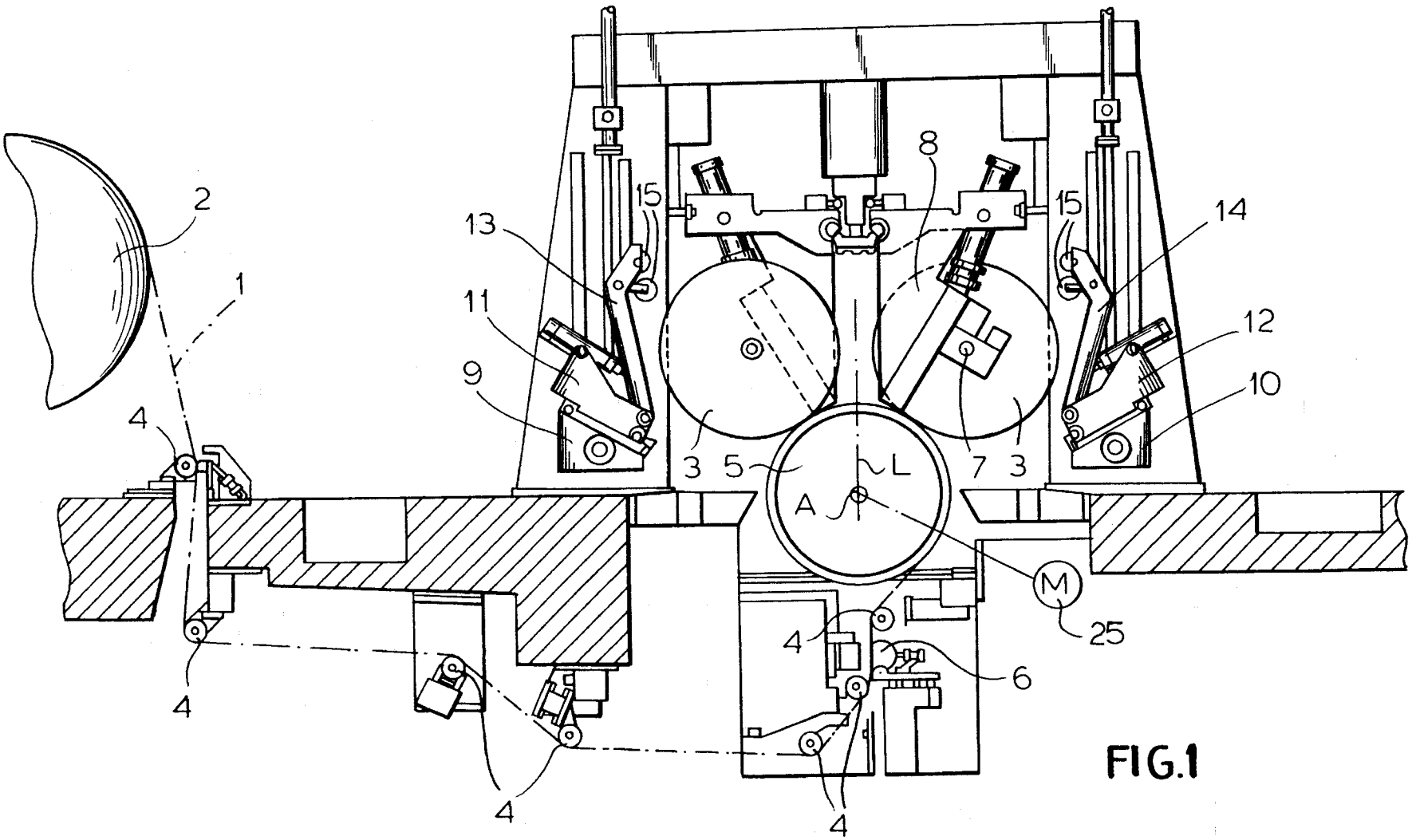
FIG. 1 shows a longitudinal section in the web travel direction generally through the middle of a support-roller winding machine according to the invention.

The more than 5 m wide paper web 1 is drawn of a supply roll 2 supported in an unwinding device, is longitudinally slit into individual webs, and is subsequently wound up into wound rolls 3. The web 1 is guided by means of guide rollers 4 from the unwinding device to the region beneath an also more than 5 m long support roller 5 where a longitudinal cutting device 6 comprised of several pairs of circular blades is provided which subdivides the web 1 into several individual webs or strips which are then alternately fed to the two winding lines.

The wound rolls 3 lie during the winding alternately to both sides of the vertical diametral line L on the driven support roll 5 whose drive motor is shown schematically at 25. They are each held by two freely rotatable guide heads 7 engageable from both ends in the winding sleeve. The guide heads 7 are supported on winding supports 8 movable transversely to the web-travel direction, each pair of winding supports 8 forming a winding station for a wound roll 3. There can be ten or more winding stations. The guide heads 7 are, in order to be able to conform their positions to the increasing wound-roll diameter, mounted on the wind supports 8 for movement radially of the support roller 5. The input and output sides of the machine are provided outside the winding region with respective raisable and lowerable traverses 9 and 10 which extend along the entire working length. Slides 11 and 12 are displaceable transverse to the web-travel direction on the traverses 9 and 10 and have pivotal arms 13 and 14 each provided with a pair of pusher rollers 15. At the start of a winding operation the pairs of freely rotatable pusher rollers 15 which are rotatable about an axis A parallel to the support-roller axis are pushed against the periphery of a winding roll 3 in order to increase the line load at the contact line between the wind roll 3 and the support roll 5 since the weight of the wound rolls 3 is insufficient.

In the above-described embodiment the guide heads 7 take up a part of the weight of the rolls as the roll diameter increases in order to maintain the line load at the contact line with the support roller at a desired low level. Instead of a single support roller 5 two support rollers can be used which define a roller cradle in which the wound rolls 3 lie during winding.

Figure 2:
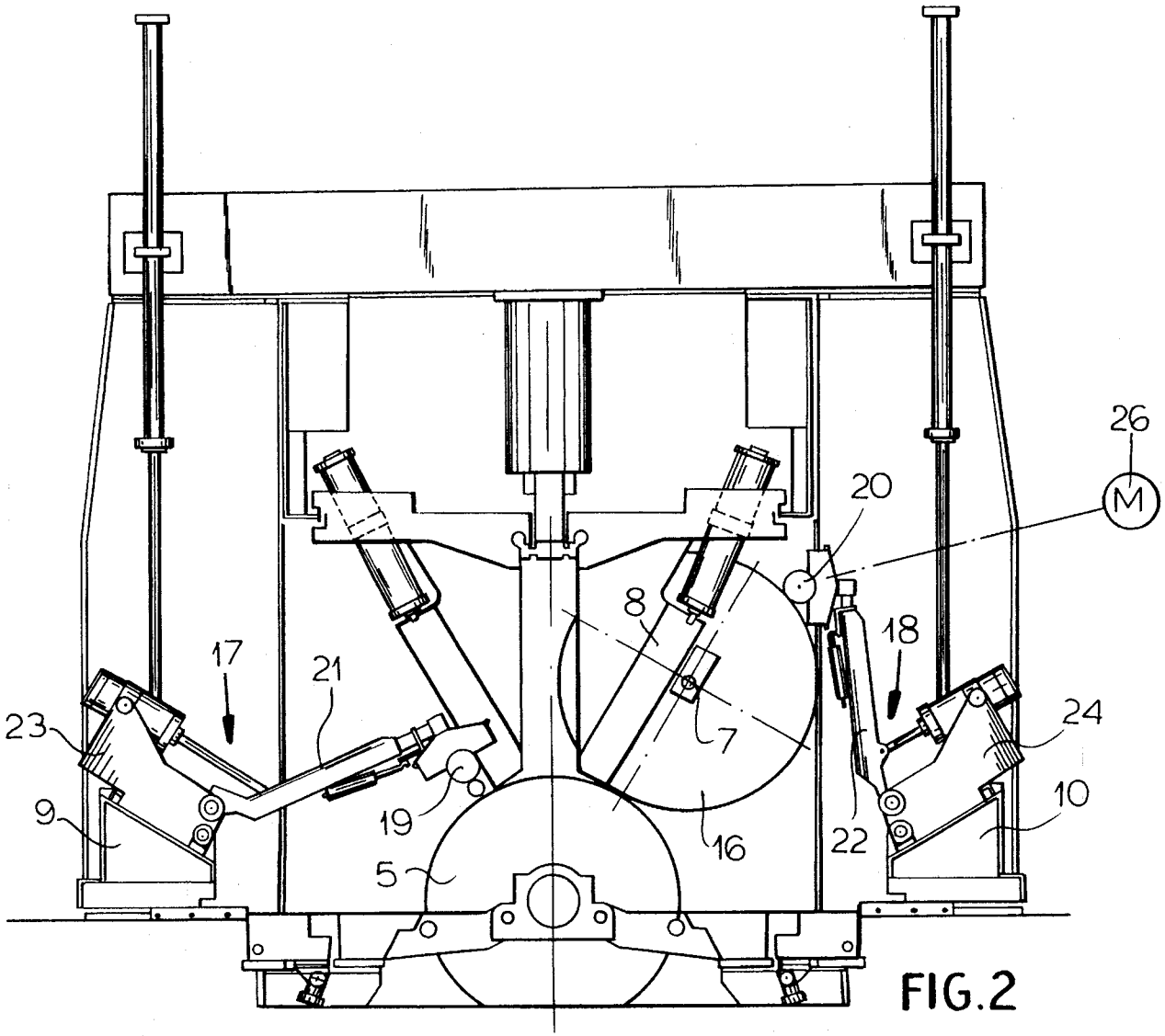
FIG. 2 shows a somewhat enlarged section at a longitudinal side of the winding machine.

FIG. 2 shows one of the two end regions at a longitudinal side of the winding machine where the outer winding roll (end roll 16) is wound. Winding takes place in two winding lines (left and right of the driven support roller 5 in FIGS. 1 and 2) and in the left winding line winding of a freshly installed winding sleeve is shown. On the two longitudinal sides of each winding line are respective additional peripheral drives 17 and 18 for the end rolls 16 so that there are all together four peripheral drives. The peripheral drives 17 and 18 are formed in the described embodiment of rollers 19 and 20 each with its own drive illustrated schematically at 26 and pressed against the respective end roll 16 with the rotation axis extending parallel to the axis of the support roller 5. The rotary drive is a so-called drum drive 26 integrated into the rollers 19 and 20 although alternately the rollers 19 and 20 can be driven by other motors (electric, hydraulic, or pneumatic) through a transmission (e.g. a belt transmission). The surfaces of the rollers 19 and 20 are elastically deformable and have grooves in order to avoid an unwanted trapping of air. They are journaled on the free ends of the pivotal arms 21 and 22 which are each mounted on a transversely displaceable slide 23 and 24. The slides 23 and 24 are movable transversely of the web-travel direction on the pusher-roller traverses 9 and 10 in order to conform the peripheral drives 17 and 18 to the current positions of the end rolls 16 and to park them out of the web region when they are not in use.

Figure 3:
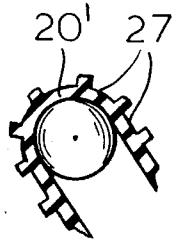
FIG. 3 is a detail view of an alternative drive element according to the invention.

Alternatively as shown in FIG. 3 to the driven rollers 19 and 20 driven belts 20 can also be used whose rotation axes also run parallel to the axis A of the support roller 5 and which are formed with entrainment grooves 27.

According to another embodiment of the invention the pairs of pusher rollers 15 shown in FIG. 1 at the ends are each provided with a switchable rotary drive and thus serve as additional peripheral drives for the end rolls 16.

The width of the driven belts or rollers 19 and 20 transverse to the web-travel direction is between 300 mm and 700 mm, preferably between 400 mm and 500 mm. The diameters of the rollers 19 and 20 is about 200 mm.

During winding of the wound rolls 3, 16 the rollers 19 and 20 are driven with a predetermined torque in order to increase the web tension to compensate for a greater web length in the edge regions of the web 1 during winding of the end rolls 16.

We claim:

1. An apparatus comprising:

an elongated support roller centered on and rotatable about a horizontal axis;

at least one row of takeup rolls coaxial to a takeup-roll axis parallel to the support-roller axis and including at least one central roll and a pair of end rolls axially flanking the central roll, the rolls being closely juxtaposed with the support roller and at least the central roll radially engaging the support roller;

supply means for feeding a relatively wide paper web to the support roller;

cutting means between the supply means and the support roller for slitting the web into a plurality of strips including at least one central strip and a pair of end strips flanking the end strip, the central and end strips passing at least partially around the support roller and being wound on the respective central and end rolls;

means for rotating the support roller about its axis so that the strips wind at least partially around the support roller and at least the central roll is rotated by engagement with the support roll;

respective end-roll periphery drives radially engaging the end rolls for rotating same at a greater peripheral speed than the support roller.

2. The roll-making apparatus defined in claim 1 wherein the periphery drives each include a peripheral drive element rotatable about an axis parallel to the support-roll axis and each drive element is movable radially of the respective roll.

3. The roll-making apparatus defined in claim 2 wherein each drive element has an elastically deformable outer surface engageable with the strip of the respective roll.

4. The roll-making apparatus defined in claim 2 wherein each drive element has a grooved outer surface.

5. The roll-making apparatus defined in claim 2 wherein each drive element is a roller.

6. The roll-making apparatus defined in claim 1, further comprising means supporting the central roll for free rotation about the takeup-roll axis.

7. The roll-making apparatus defined in claim 1, further comprising a second such row of such takeup rolls coaxial to a second takeup-roll axis parallel to the support-roller axis and the first-mentioned takeup-roll axis and including at least one central roll and a pair of end rolls axially flanking the respective central roll, the rolls of the second row being closely juxtaposed with the support roller and at least the central roll of the second row radially engaging the support roller, the cutting means subdividing the web longitudinally into a respective strip for each roll;

respective end-roll periphery drives radially engaging the end rolls of the second row for rotating same at a greater peripheral speed than the support roller.

8. The roll-making apparatus defined in claim 1 wherein the support roller has an axial length of at least 5 m and the rolls have an axial length of between 300 mm and 700 mm.

* * * * *